US007179215B2

(12) United States Patent
Focke et al.

(10) Patent No.: US 7,179,215 B2
(45) Date of Patent: Feb. 20, 2007

(54) PROCESS AND APPARATUS FOR PRODUCING PACKS WITH AN OUTER WRAPPER AS WELL AS REEL UNIT

(75) Inventors: Heinz Focke, Verden (DE); Martin Stiller, Verden (DE); Johann Köster, Verden (DE); Gerhard Westermann, Walsrode (DE)

(73) Assignee: Focke & Co. (GmbH & Co.) (DE)

( * ) Notice: Subject to any disclaimer, the term of this patent is extended or adjusted under 35 U.S.C. 154(b) by 426 days.

(21) Appl. No.: 09/990,796

(22) Filed: Nov. 14, 2001

(65) Prior Publication Data

US 2002/0065181 A1 May 30, 2002

(30) Foreign Application Priority Data

Nov. 24, 2000 (DE) ..... 100 58 575
Feb. 7, 2001 (DE) ..... 101 05 486

(51) Int. Cl.
*B31B 1/00* (2006.01)

(52) U.S. Cl. ..... 493/22; 493/17; 493/377; 493/930; 493/963

(58) Field of Classification Search ..... 493/3, 493/11, 13, 17, 377, 930, 963, 22; 53/412, 53/389.2, 389.3, 389.4, 131.5, 133.5–133.8; 156/260, 265

See application file for complete search history.

(56) References Cited

U.S. PATENT DOCUMENTS 2,334,381 A * 11/1943 Bronander ..... 493/346
2,683,401 A * 7/1954 Smith ..... 493/341
2,864,285 A * 12/1958 Roselius ..... 493/8
2,983,091 A 5/1961 Wheeler
3,013,368 A 12/1961 Macomber
3,272,673 A * 9/1966 Heinz-Hermann ..... 156/260
3,551,245 A * 12/1970 Gamberini ..... 156/260
3,877,633 A * 4/1975 Peck et al. ..... 206/216

(Continued)

FOREIGN PATENT DOCUMENTS

DE 3026856 2/1982

(Continued)

OTHER PUBLICATIONS

Yamazaki, Masashi, Examiner's Notice Re Notification of Reasons For Rejection, Feb. 20, 2006, pp. 1-4, Japanese Patent Office, Japan.

(Continued)

*Primary Examiner*—Louis K. Huynh
*Assistant Examiner*—Thanh Truong
(74) *Attorney, Agent, or Firm*—Laurence P. Colton; Powell Goldstein LLP

(57) ABSTRACT

In the production of packs with outer wrappers which have a tear-open strip (12), the latter of continuous material strips (18), for the purpose of severing the tear-open strips (12), are provided with printing, markings (24), etc. Moreover, the film webs (13) from which the outer wrappers are made also are preferably provided with markings, printing or printed marks (25). Sensing elements help to detect the relative positions of the tear-open strip (12) and the film webs (13) on account of the printing and the drive of the film web (13) and/or of the material strip (18) is controlled accordingly.

4 Claims, 11 Drawing Sheets

U.S. PATENT DOCUMENTS

Figure 1:
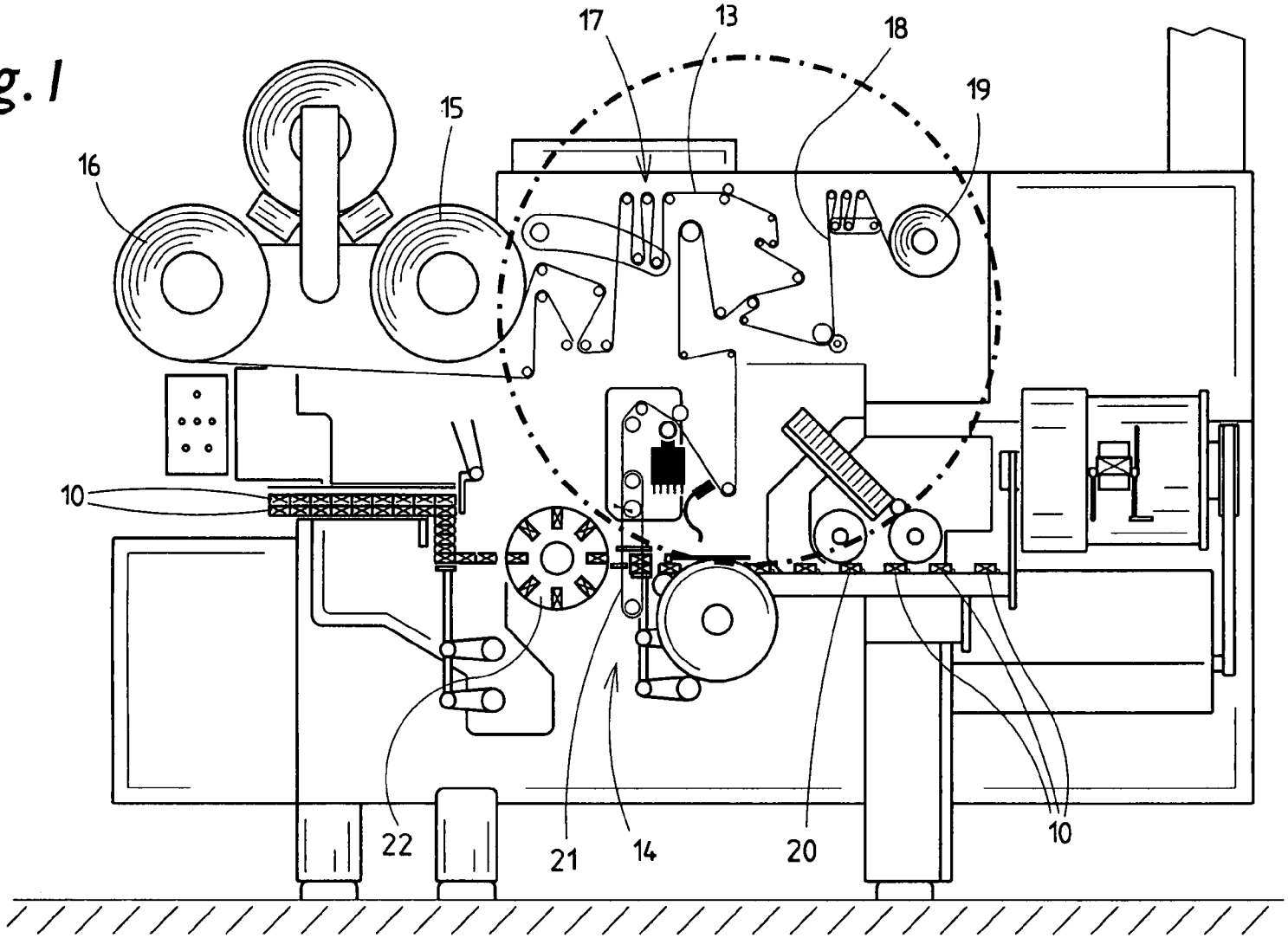

| | | | | | |
|---|---|---|---|---|---|
| 4,676,047 | A | * | 6/1987 | Mutoh | 53/131.5 |
| 4,836,378 | A | * | 6/1989 | Lephardt | 206/459.5 |
| 4,947,994 | A | * | 8/1990 | Newsome | 229/203 |
| 4,991,597 | A | * | 2/1991 | Demny | 131/280 |
| 5,085,725 | A | | 2/1992 | Focke | |
| 5,104,366 | A | * | 4/1992 | Bunch | 493/23 |
| 5,470,300 | A | * | 11/1995 | Terranova | 493/11 |
| 5,483,893 | A | * | 1/1996 | Isaac et al. | 101/485 |
| 5,735,987 | A | * | 4/1998 | Boriani et al. | 156/176 |
| 5,928,749 | A | * | 7/1999 | Forman | 428/43 |
| 5,931,292 | A | * | 8/1999 | Focke et al. | 206/264 |
| 6,138,437 | A | | 10/2000 | Focke | |
| 6,454,689 | B1 | * | 9/2002 | Voss | 493/11 |
| 6,508,173 | B1 | * | 1/2003 | Focke et al. | 101/485 |

FOREIGN PATENT DOCUMENTS

| | | |
|---|---|---|
| DE | 3123544 | 12/1982 |
| DE | 19619558 | 11/1997 |
| EP | 0960818 | 12/1999 |
| FR | 1487209 | 6/1967 |
| FR | 2774668 | 8/1999 |
| GB | 1057022 | 2/1967 |
| JP | 54-118733 | 4/1981 |
| JP | 58-201611 | 11/1983 |
| JP | 60-045138 | 10/1986 |
| JP | 09-202373 | 8/1997 |
| JP | 2000-016417 | 1/2000 |
| JP | 2000-191196 | 7/2000 |
| JP | 2000-229606 | 8/2000 |

OTHER PUBLICATIONS

Copy of European Patent Office Search Report.

Kusunaga, Yoshitaka, Examiner's Notice Re Notification of Reasons For Rejection, Aug. 17, 2006, Japanese Patent Office, Japan (Japanese and English Translation).

* cited by examiner

Fig. 11
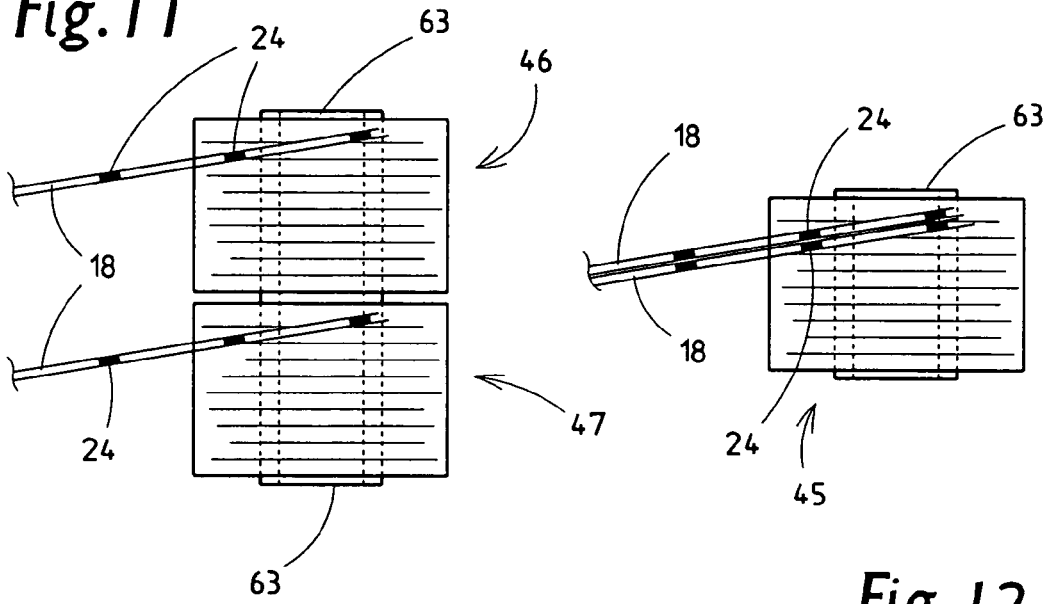
Fig. 12
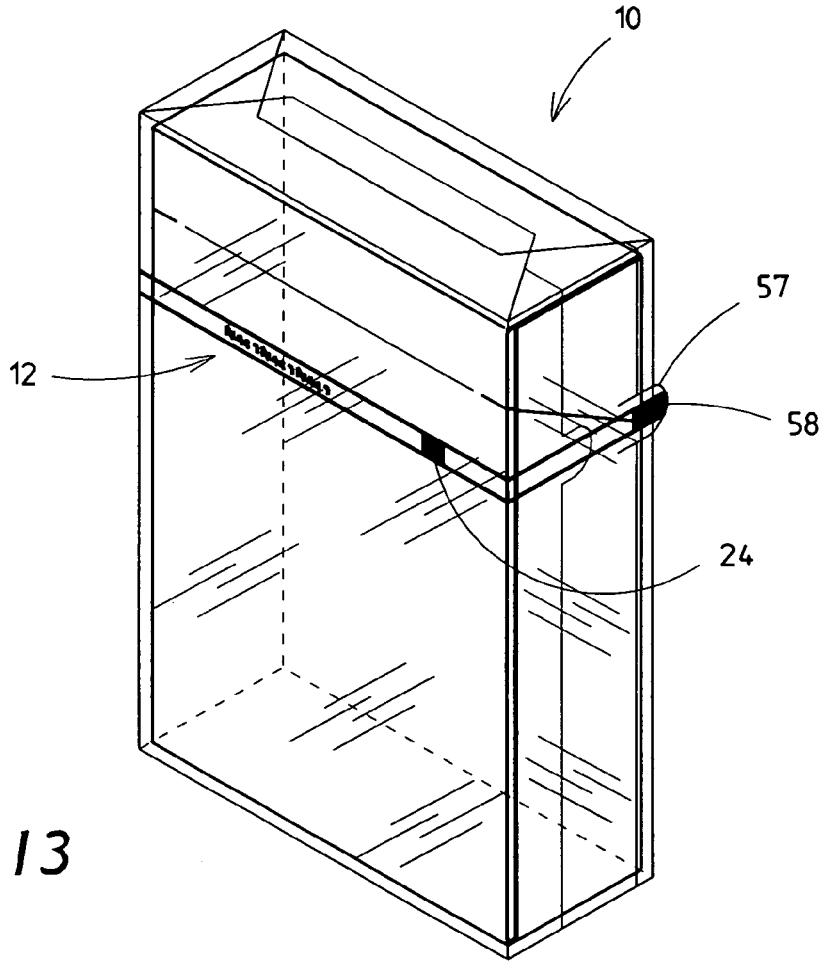
Fig. 13

PROCESS AND APPARATUS FOR PRODUCING PACKS WITH AN OUTER WRAPPER AS WELL AS REEL UNIT

BACKGROUND OF THE INVENTION

1. Technical Field

The invention relates to a process for producing packs with an outer wrapper made of (transparent) film and with a tear-open strip applied to the outer wrapper, blanks for the outer wrapper being severed from a continuous film web with tear-open strip. The invention also relates to an apparatus for carrying out the process as well as to a specially-configured reel for a material strip.

2. Prior Act

Packs with contents of various kinds, in particular cigarette packs, are frequently provided with an outer wrapper made of, in particular, transparent film which can be removed with the aid of a tear-open strip. The tear-open strip usually has a grip end indicated by color.

BRIEF SUMMARY OF THE INVENTION

The invention is concerned with measures for applying the tear-open strip to the outer wrapper, or to the film web for producing blanks for outer wrappers.

The object of the invention is to take measures for the optimum availability and precise positioning of the tear-open strip and/or for the precise production of the blanks provided with tear-open strips.

In order to achieve this object, the process according to the invention is characterized by the following features:

a) a continuous material strip for producing the tear-open strip is provided with precisely positioned printing, markings or the like,
b) the printing, markings, etc. are sensed by a sensor—printed-mark reader,
c) the precise position of the tear-open strip on the film web and/or a severing cut for severing the blanks with tear-open strip from the film web is controlled in accordance with the detected printing, markings, etc.

This printing may be constituted by straightforward colored or highly contrasting markings or printed marks. However, the printing may also provide information, advertising or manufacturer's instructions, which form on the material strip a marking which can be sensed. This marking is detected by optoelectronic sensors, namely printed-mark readers, and is used for the purpose of controlling the conveying drive for the film web and/or of the material strip and for the purpose of controlling severing elements for severing tear-open strips from the material strip or blanks from the film web. If the film web and/or the material strip are themselves affected, this takes place via a correspondingly controlled drive of conveying elements, particularly conveying rollers.

Another special feature of the invention is constituted by measures for double-web operation. A double-width film web is severed centrally in order to form individual film webs. A material strip for the tear-open strip is made available to each of these film webs. The two separate tear-open strips or material strips may be made available to the film webs either separately from two separate reels or by a double-width material strip being severed centrally.

It is advantageous that each material strip is assigned a strip reel from which material strips for each film web are drawn off in a precise, synchronously controlled movement. The material strips are wound in corresponding structures on the strip reels, in particular such that, with the strip reels running in the same direction, the material strips are always drawn off from the associated reel in parallel positions relative to one another. The arrangement of the two reels on a common carrier, in particular on a common, correspondingly dimensioned reel sleeve, is particularly important.

According to a further special feature of the invention, the material web is also provided with printing or markings which is or are sensed by associated printed-mark readers. This makes possible increased accuracy in the case of the control for the precise positioning of tear-open strips and/or severing cuts.

A BRIEF SUMMARY OF THE DRAWINGS

Figure 2:
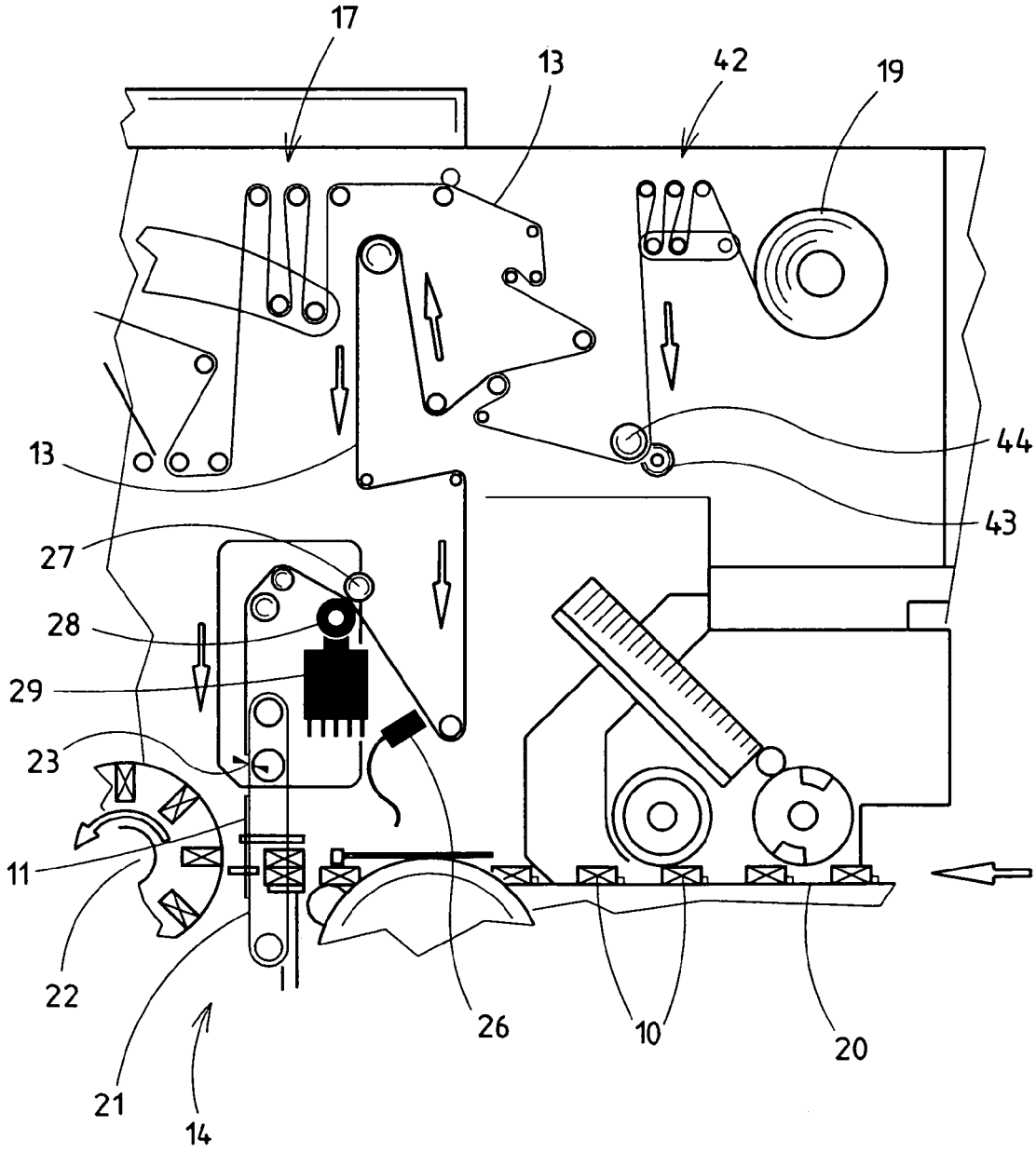
Figure 3:
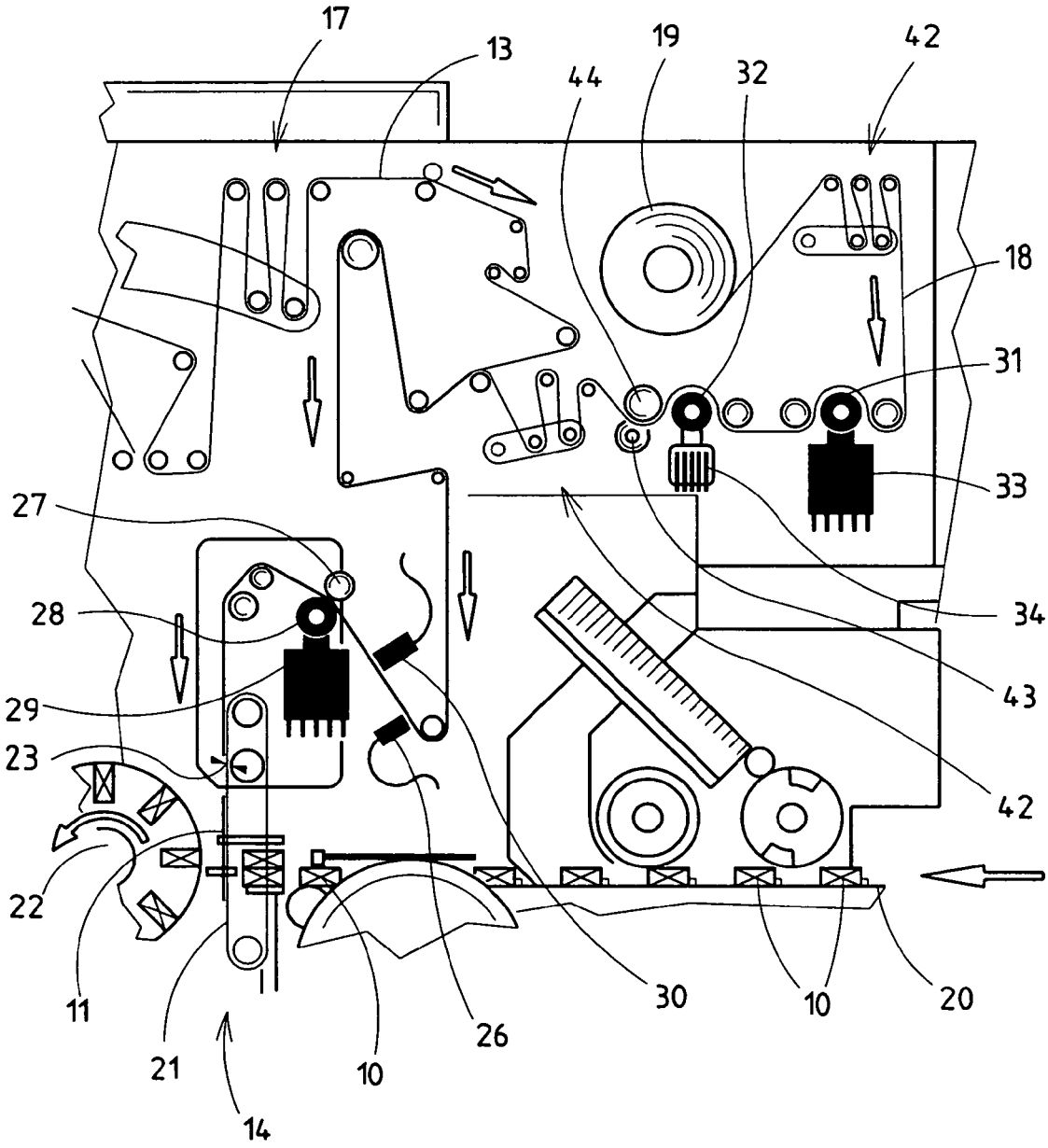
Figure 4:
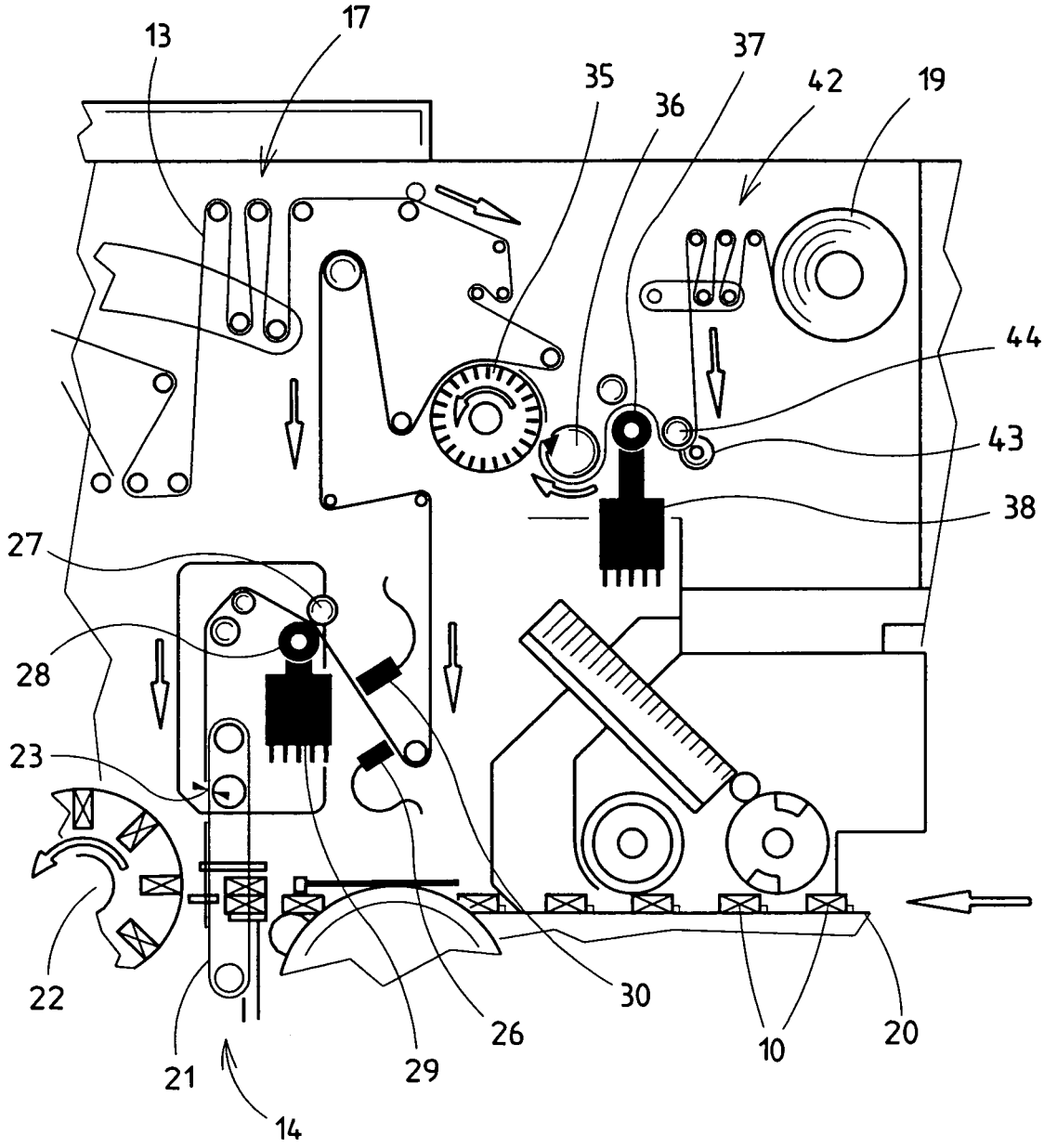
Figure 5:
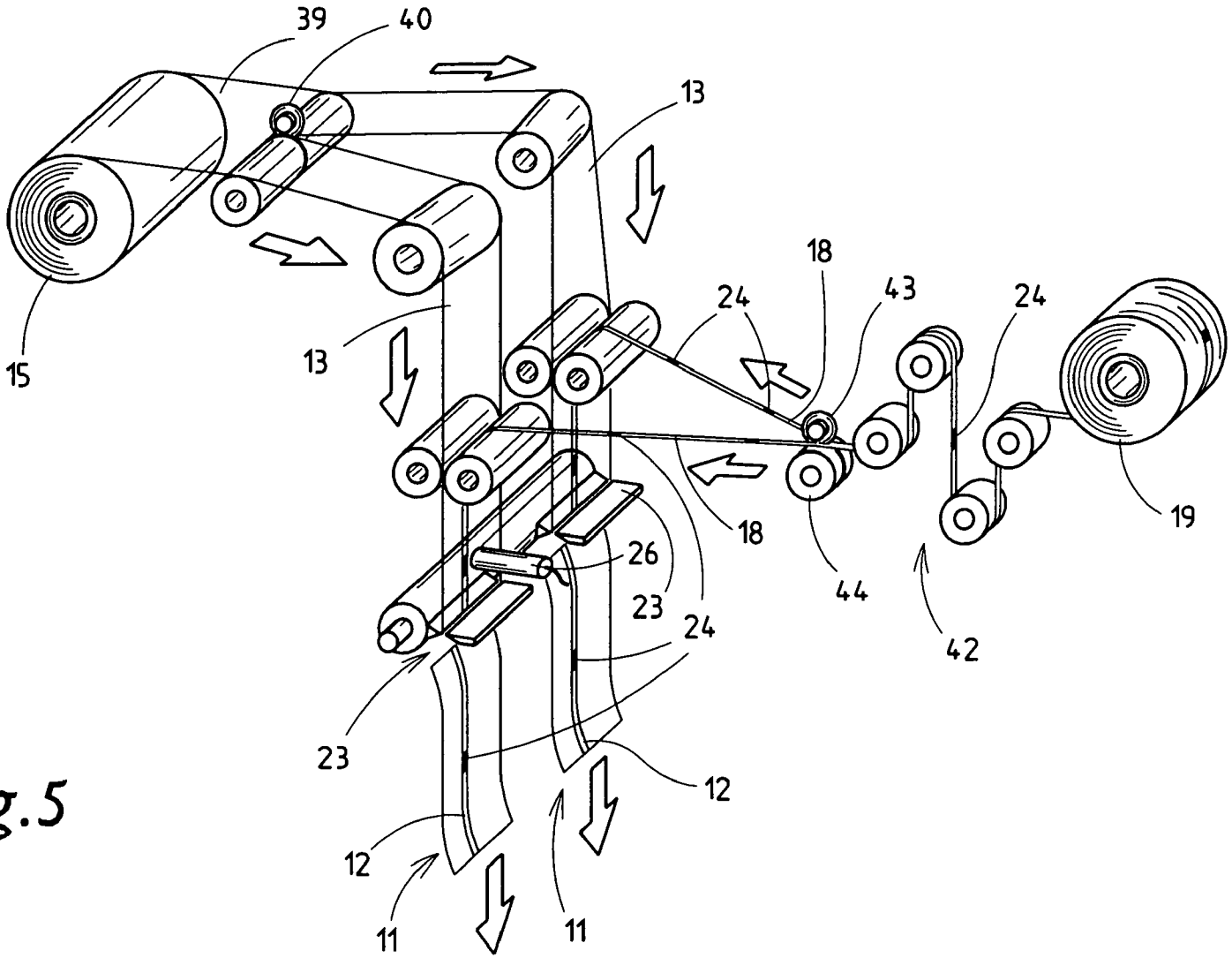
Figure 6:
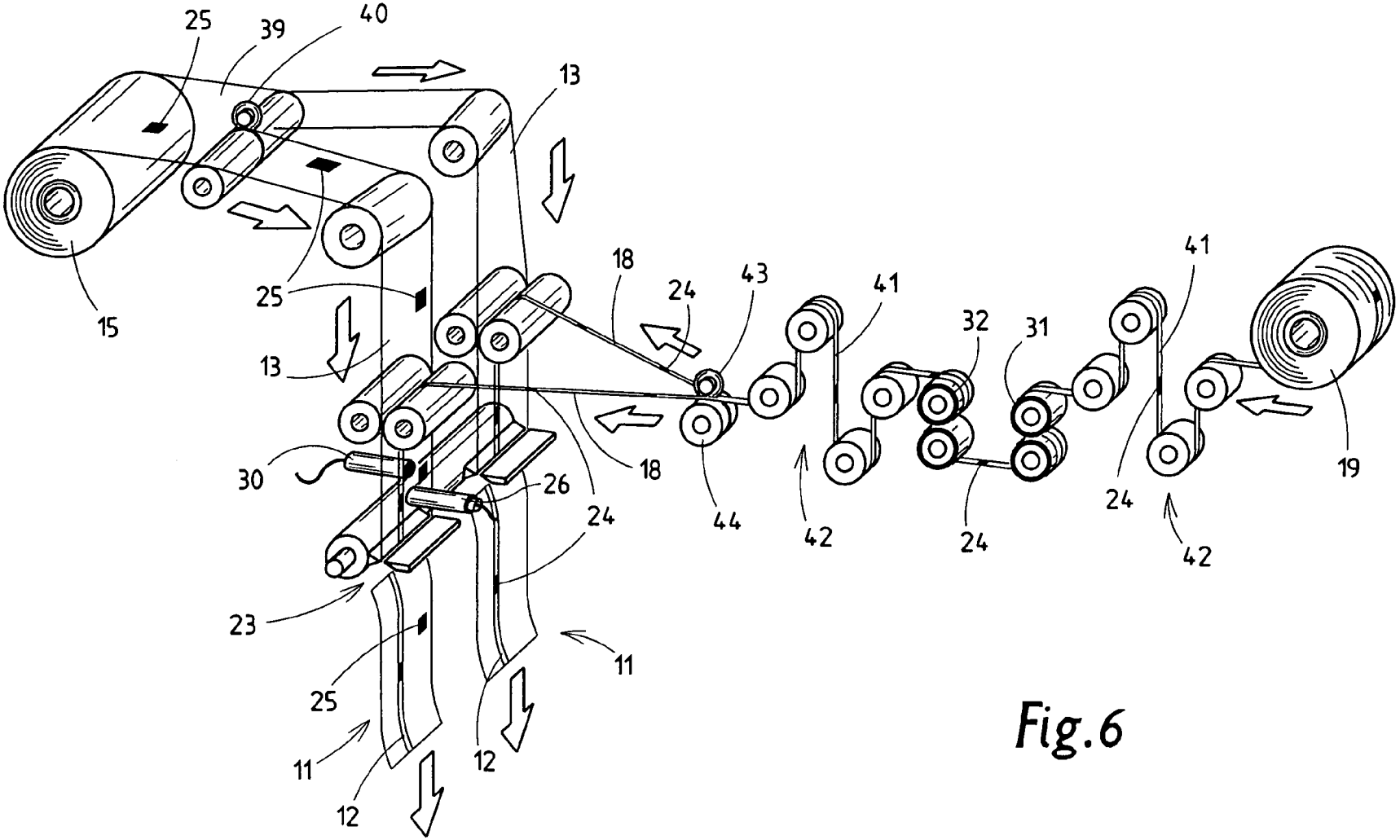
Figure 7:
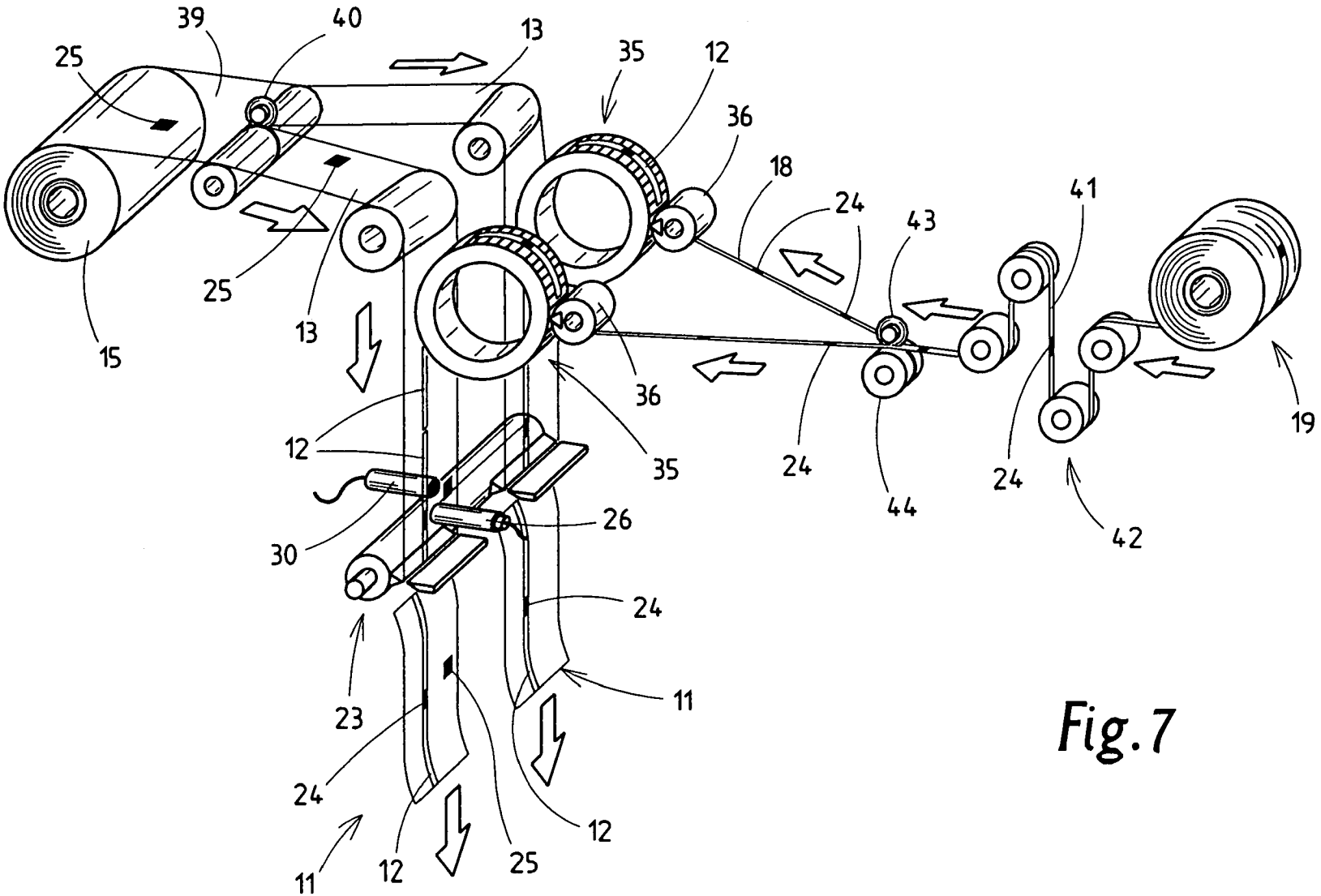
Figure 8:
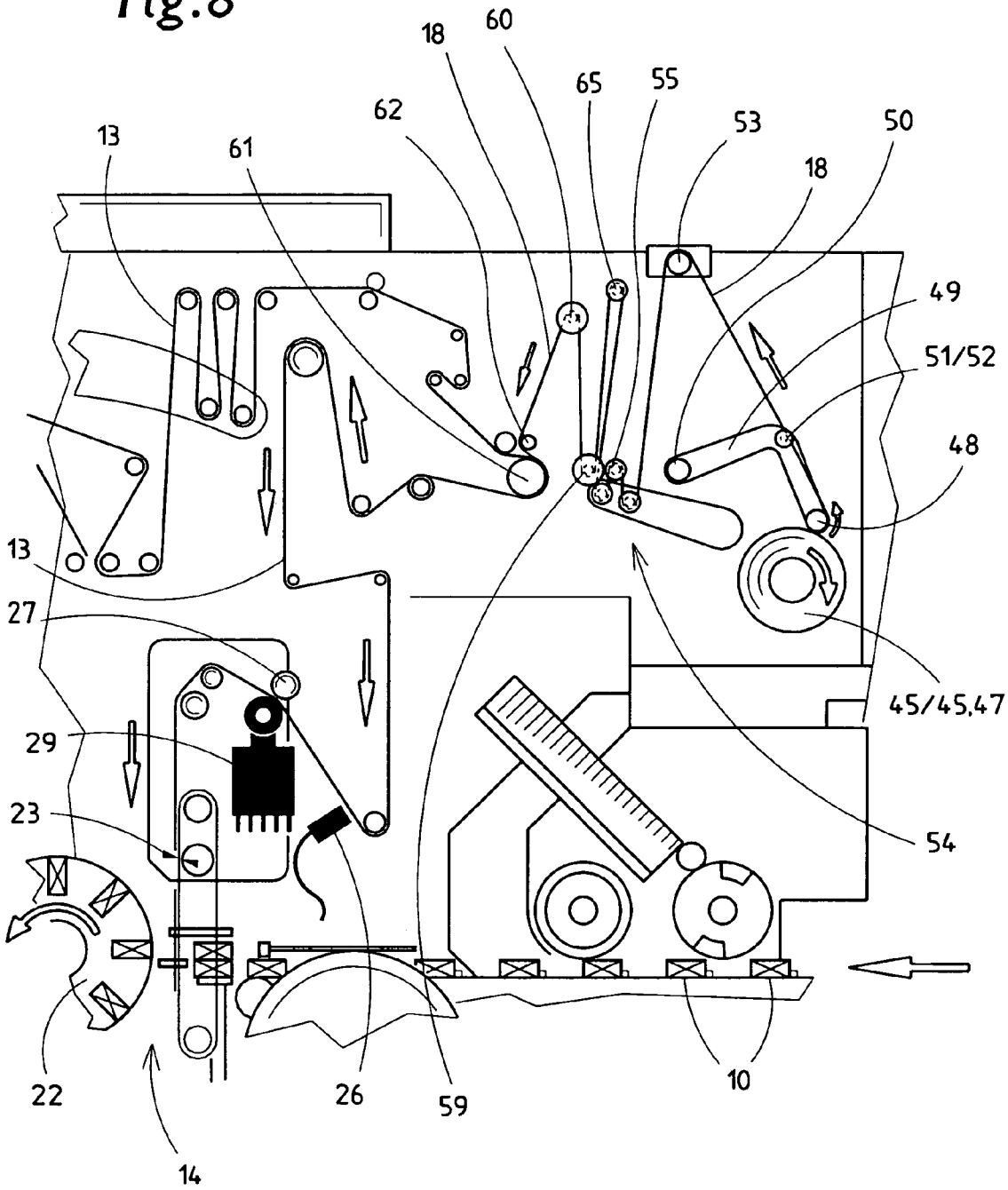
Figure 9:
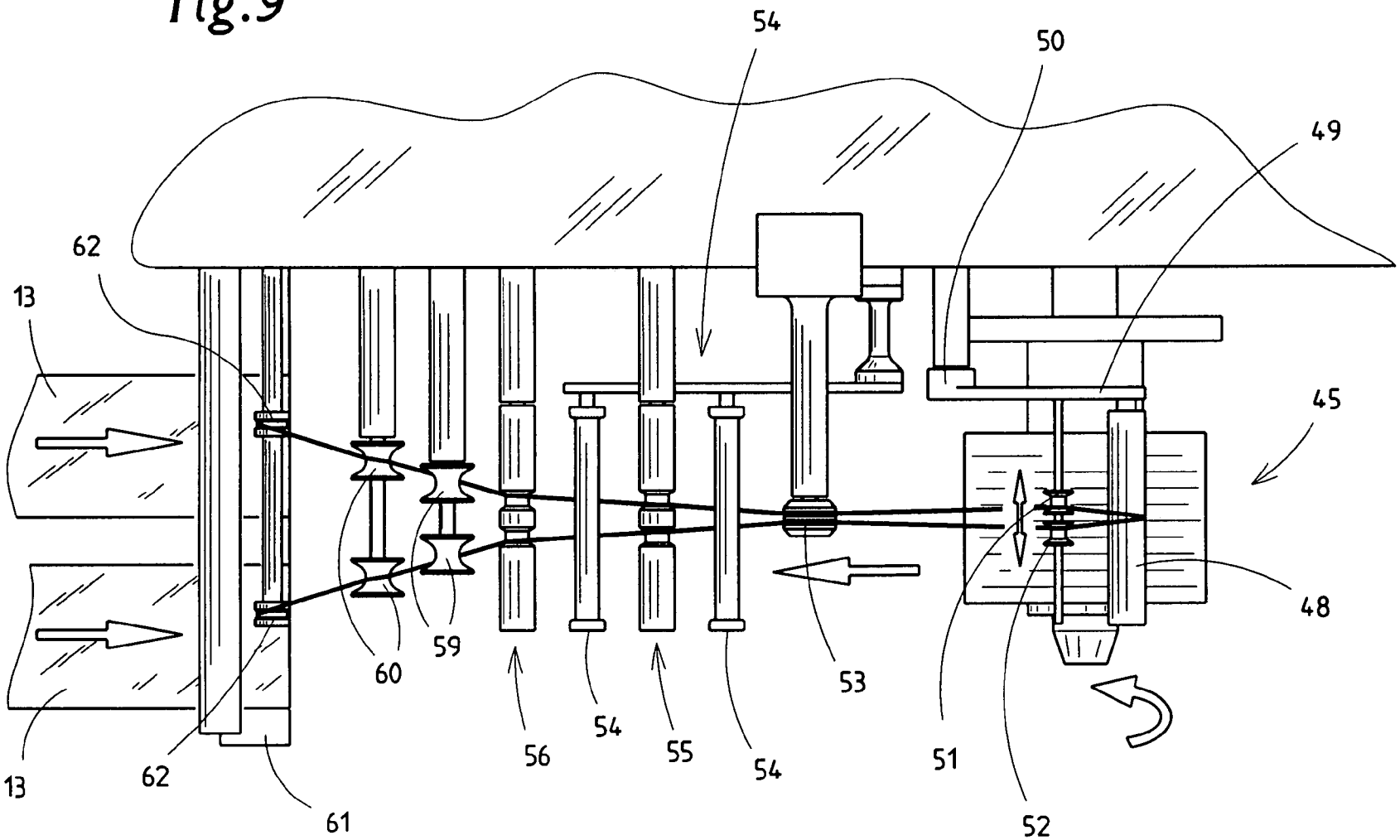
Figure 10:
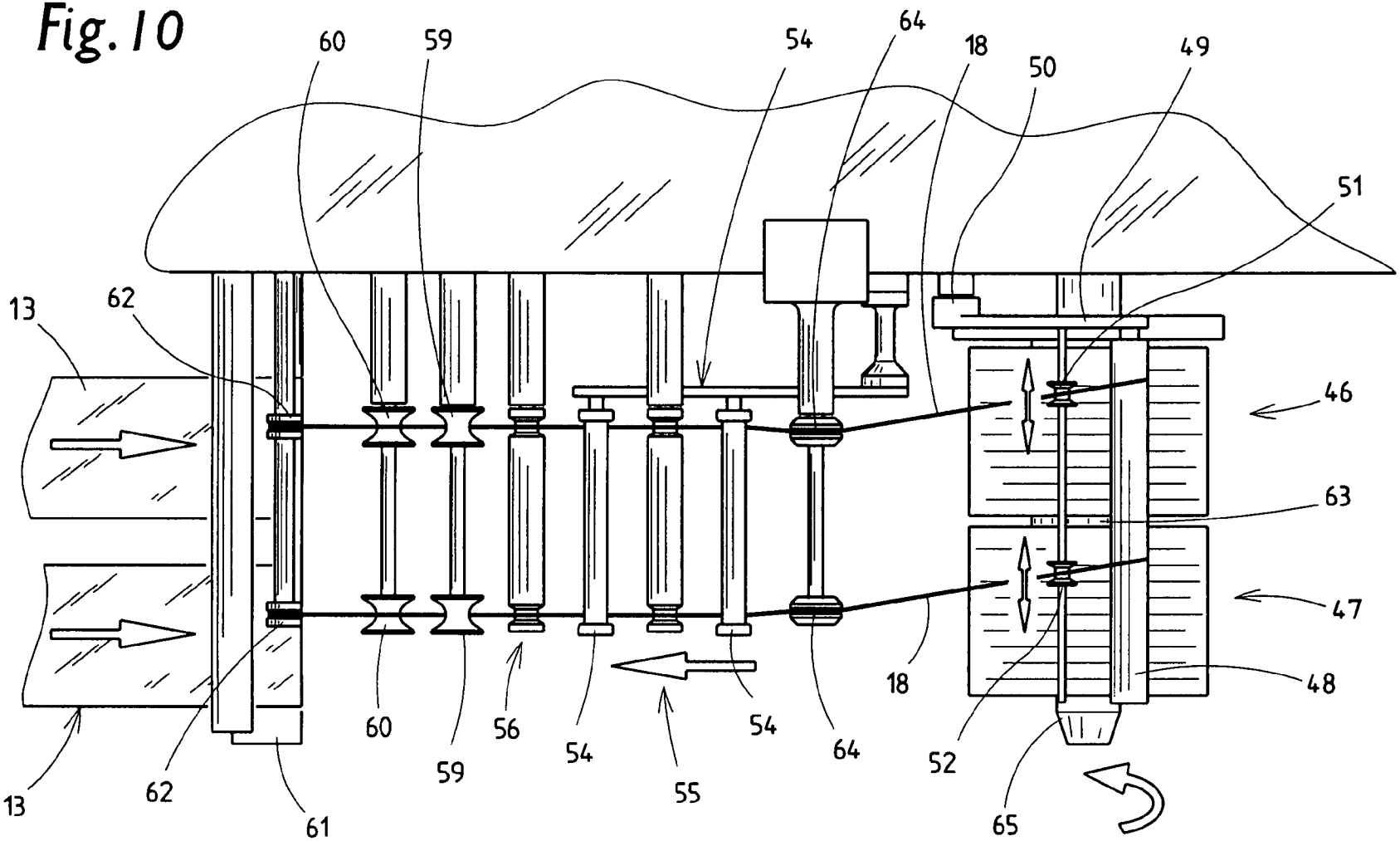

Further details of the invention are illustrated below with reference to use examples and exemplary embodiments illustrated in the drawings, in which is shown:

FIG. 1 a simplified side view of a packaging machine for applying outer wrappers, FIG. 2 a detail of the packing machine which is marked in FIG. 1, on an enlarged scale, FIG. 3 an illustration analogous to FIG. 2 for another exemplary embodiment of the packaging machine, FIG. 4 an illustration analogous to FIGS. 2 and 3 for a third exemplary embodiment, FIG. 5 a perspective illustration of the course taken by the material for the exemplary embodiment according to FIG. 2, FIG. 6 likewise in perspective, the material flow for the exemplary embodiment according to FIG. 3, FIG. 7 an illustration analogous to FIG. 6 with a different material flow, FIG. 8 an illustration analogous to FIG. 3 or FIG. 4 in a modified embodiment, FIG. 9 top view of the details of the embodiment according to FIG. 8, on an enlarged scale FIG. 10 an illustration analogous to FIG. 9 of another embodiment with respect to providing the tear-open strips, FIG. 11 a detail in the exemplary embodiment according to FIG. 10, FIG. 12 an alternative form with a single strip reel, FIG. 13 perspective view of a (cigarette) hinged-lid box as a practical example.

DETAILED DESCRIPTION OF THE PREFERRED EMBODIMENTS

The exemplary embodiments in the drawings are concerned with the production of cuboidal (cigarette) packs 10 with a conventional outer wrapper made of thin, transparent film. The packs 10 may be of the hinge-lid (FIG. 13) or soft-carton type. It is also the case, however, that other types of packs are provided with an outer wrapper.

The outer wrapper, which encloses the pack 10 on all sides, is formed by a blank 11, which encloses the entire pack. In a top region of the pack 10 directed towards an end wall, the outer wrapper or the blank 11 is provided with an encircling tear-open strip 12. The tear-open strip 12 is provided, at an outer end, with a grip end 57 indicated by a colored marking 58.

The packaging machine for applying the outer wrapper to the packs 10 processes a continuous film web 13 made of thin, tearable film. From this web, the blanks 11 are severed in the region of a blank station 14 and transferred to the packs 10. The film web 13 is drawn off continuously from a respectively active reel 15. A replacement reel 16 is available in each case.

The film web 13 is guided over a multiplicity of deflecting rollers and over a compensating pendulum arrangement 17. The latter allows compensations in the case of a possibly increased or reduced conveying speed of the film web 13.

The tear-open strip 12 is severed from an appropriately formed continuous material strip 18. This too is drawn off from a strip reel 19. It is preferable for the material strip 18 to be coated with an adhesive on one side, said adhesive making it possible for the material strip 18, or the tear-open strip 12 severed therefrom, to be connected to the film web 13 by adhesive bonding.

The packs 10 coming from a packaging machine are fed to the blank station 14 on a pack path 20. The blank 11 severed from the film web 13 is held ready here in an upright plane, to be precise by suction belts 21. The respective pack 10 is conveyed transversely through the plane of said blank 11, in which case the blank 11 is carried along by the pack 10, wrapping around the latter in a U-shaped manner in the process, and the two are pushed into a folding turret 22. On the opposite side, the packs 10 provided with the blank 11 or the outer wrapper pass out of the folding turret 22.

The tear-open strip 12 may be connected to the film web 13 and/or the blank 11 in different ways. It is thus possible for the continuous material strip 18 to be advanced up to the film web 13 and connected thereto. A severing subassembly 23 in each case with a circulating cutter and a fixed mating cutter then also severs, along with the blank 11, the tear-open strip 12 from the material strip 18 (solution according to FIGS. 2 and 5).

An alternative provides that tear-open strips 12 of the correct length are severed from the (free) material strip 18 and are then positioned precisely on the film web 13. In this case, the severing cut carried out in the region of the severing subassembly 23 is made between mutually facing ends of adjacent tear-open strips 12 (solution according to FIGS. 4 and 7).

A special feature consists in that the material strip 18 for producing the tear-open strip 12 is itself already provided with at least one imprint. This imprint is applied by suitable printing units during the industrial production of the material strip 18. The imprints here may be constituted by markings, namely colored or black marks. The material strip 18 is advantageously provided with markings for the grip end which are applied in a precisely positioned manner at distances apart from one another. Alternatively, or in addition, it is possible to apply contents-related or decorative printing, for example manufacturer's instructions, etc. Furthermore, according to a further development, the film web 13 is also provided with printing, markings or the like, these likewise being applied in a precisely positioned manner during the production of the film web 13. It is also possible here for the printing to be informative or decorative, but, in a simple scenario, to be constituted by printed marks 25.

The task, then, is, on the one hand, to position the tear-open strip 12 in a precise position relative to the blank 11 in respect of the printing and, on the other hand, to apply a correct severing cut, that is to say to produce a blank 11 which is formed correctly in respect of the printing and markings.

For this purpose, the printing, markings, etc. provided are sensed by optoelectronic sensors. The sensed data regarding any relative positioning of the printing, markings, etc. are used for the purpose of adjusting the film web 13, the material strip 18, the tear-open strip 12 or the severing cut.

In the exemplary embodiment according to FIG. 2, the film web 13 provided with the material strip 18 is assigned a printed-mark reader 26, which detects printing or markings 24 in the region of the material strip 18 and also detects any incorrect position. The printed-mark reader 26 is connected to a known evaluation unit (not shown). This, in turn, controls the conveying movement of the film web 13 in accordance with any possible deviations established. In the exemplary embodiment according to FIG. 2 (and FIG. 5), these deviations concern the correct positioning of the severing cut by the severing subassembly 23. Incorrect position are compensated for by a change in the drive of the film web 13. For this purpose, the film web 13 is conveyed, in the region adjacent to the blank station 14, by drive rollers 27, 28, of which at least one drive roller 28 is connected to a controllable drive, namely to a servomotor 29. In accordance with the data picked up from the printed-mark reader 26, said servomotor changes, if necessary, the advancement of the film web 13 in one direction or the other, this resulting in the positioning of the severing cut being changed correspondingly. For this purpose, the drive roller 28 is provided with a suitable outer coating made of a material with increased frictional resistance, for example rubber material, plastic or silicone.

In the case of the solution according to FIG. 3, in addition to the material strip 18, the film web 13 is also provided with printing, namely, by way of example, with printed marks 25. These are detected by an associated printed-mark reader 30, which in this case is positioned on the side opposite to the printed-mark reader 26. The printed-mark reader 30 is also connected to the evaluation unit. By virtue of the interaction of the printed-mark readers 26 and 30, it is possible, in addition, to detect and, if necessary, to adjust the relative position of the tear-open strip 12 or of the material strip 18 on the blank 11 or the film web 13.

For this purpose, the conveying movement of the material strip 18 is controlled before the latter is connected to the film web 13. The material strip 18 is deflected about a first conveying roller 31 and then about a second conveying roller 32. Sufficient deflection of the material strip 18 in the region of the conveying roller 31, 32 is brought about in each case by two deflecting rollers arranged on both sides of the conveying rollers 31, 32.

The conveying roller 31 is connected to a controllable drive, namely to a servomotor 33. The latter can be controlled by the printed-mark readers 26 and/or 30. The servomotor 33 or the conveying roller 31 interacts with the conveying roller 32, with is driven by a motor 34, which may likewise be a servomotor. The two conveying rollers 31 and 32 have their surfaces designed such that they can transmit drive power to the material strip 18. The servomotor 33 may be controlled for the purpose of changing the relative position of the tear-open strip 12 and/or of the printing (marking 24) applied thereto. In particular, incorrect positions are compensated for in that the conveying roller 31 is driven at a slightly lower speed than the conveying roller 32, this bringing about a slight extension in the material strip 18 with a correspondingly slight change in the position of the printing, markings 24, etc. Adjustment in this way is carried out in a number of steps or in is small steps over a certain period of time, with the result that the lengthening or extension of the material strip 18 is not important.

FIGS. 4 and 7 show a solution in the case of which the tear-open strip 12 is severed from the material strip 18 and then transferred to the film web 13 in a precisely positioned manner. For this purpose, the film web 13 is guided over a suction roller 35, which likewise transports the individual tear-open strips 12 along the circumference and positions them against the film web 13. The adhesive layer of the tear-open strips 12 is directed outwards in this case.

Arranged upstream of the suction roller 35 is a severing subassembly, namely a circulating cutter roller 36 which, in conjunction with the circumference of the suction roller 35, severs from the material strip 18 a section which serves as a tear-open strip 12, and transfers said section to the suction roller 35.

In this exemplary embodiment, tear-open strip 12 or material strip 18 and film web 13 are provided with printing, markings or printed marks which are to be coordinated with one another. For the correct severing cut in the region of the blank station 14, the printed-mark reader 26 is assigned to the markings 24. The printed-mark reader 30 assigned to the printing of the film web 13, that is to say, for example, to the printed mark 25, controls a drive for the material strip 18, to be precise a conveying roller 37 which is driven by a control servomotor 38. Directing rollers ensure that there is sufficient wrap around the conveying roller 37. The latter is positioned directly adjacent to the cutter roller 36, as seen in the conveying direction of the material strip 18. In accordance with detected incorrect positions of the printing, the conveying roller 37 may be driven at a higher or a reduced conveying speed. In the case of a lower conveying speed, it is possible for small, negligible gaps to appear between the tear-open strips 12 positioned on the film web 13. The elements which act as the material strip 18 or the tear-open strip 12 is conveyed, namely the suction roller 35 and the cutter roller 36, are driven, by machine control, at a constant speed. Since slight slippage may occur in the region of the cutter roller 36 as a result of the change in the conveying movement of the material strip 18, and the material strip 18 is positioned on the circumference of the cutter roller 36 by way of the glue-containing side, said cutter roller is provided with a special surface coating, in particular made of silicone.

One special feature is provided by measures for double-web operation for the simultaneous production of two blanks 11 (with tear-open strips 12). Two film webs 13 are supplied to the blank station 14 in the same plane at a transverse distance apart from one another. The two film webs 13 are produced from a double web 39, by the latter being severed centrally with a fixed cutter 40 and being conveyed in a divergent manner.

Analogously to this, the two film webs 13 are to be fed two material strips 18 at a corresponding distance from one another.

In the exemplary embodiment according to FIG. 5, a double strip 41, that is to say a double-width material strip, is made available. This is provided with markings 24 over its entire width such that, once the double strip 41 has been divided, each material strip 18 has the markings 24. The double strip 41 is fed to a severing station over deflecting rollers of a compensating pendulum arrangement 42. In the region of said severing station, the double strip 41 is severed centrally by a round, circulating cutter 43, which interacts with a supporting roller 44. The severing cut is made in the region of an encircling groove of the supporting roller 44. By virtue of the (two) material strips 18 formed being fed to further, axially spaced-apart deflecting rollers, the material strips 18 are made to diverge, with the result that they are conveyed at the necessary distance from one another.

Each film web 13 may be assigned a monitoring device with the printed-mark readers 26, 30 of the configuration described above. It has been found, however, that sufficiently precise control of the two film webs 13 in respect of the tear-open strips 12 is possible if just one film web 13 is monitored. This applies to the markings applied to the tear-open strip 12 in the exemplary embodiment according to FIG. 5, but also for the printing, for example printed marks 25, which is/are applied to the film web 13 according to FIGS. 6 and 7 and, accordingly are applied eccentrically to the double web 39 and is/are present merely on one of the two film webs 13 following the severing operation.

FIG. 6 shows a perspective illustration of the material flow for the exemplary embodiment from FIG. 3, that is to say with control of the movement of the material strip 18 or of the double strip 41 by the conveying rollers 31 and 32. The double strip 41 is severed centrally following the compensating pendulum arrangement 42, to be precise in a manner described in conjunction with FIG. 5.

FIG. 7 is the perspective illustration for the exemplary embodiment according to FIG. 4, although the conveying roller 37 is not illustrated. The double strip 41, which is drawn off from a common reel, namely strip reel 19, is divided before tear-open strips 12 are severed, that is to say upstream of the cutter roller 36, as seen in the conveying direction. The material strips 18 formed are spaced apart from one another and fed to separate cutter rollers 36 and following suction rollers 35, as has been described in detail in conjunction with FIG. 4.

FIG. 8 to FIG. 10 show special features with respect to making material strips 18 available for the production of the tear-open strips 12 for double-web operations. In each case, two separate material strips 18 are simultaneously drawn off a special strip reel 45 or from a double reel having two individual reels 46, 47 (FIG. 10). In the embodiment according to FIG. 9, shown in detail in FIG. 12, two separate, printed material strips 18 lying directly adjacent to one another in a precise relative position are wound on the mutual strip reel 45. The two material strips 18 are unwound from the strip reel 45 synchronously and with no change in their relative position while lying adjacent to one another. They are then separated from one another until they are transferred in precise positioning to the assigned film web 13.

In this process, the two closely adjacent material strips 18 first run over a deflecting roller 48, which is mounted axis-parallel to the strip reel 45 on a displaceable support, namely on a single-arm, curved or angular bearing lever 49. The latter is mounted on a stationary drag bearing 50 at an end farther away from the deflecting roller 48. The deflecting roller is mounted adjacent to the (variable) circumference of the strip reels 45 or lies at the circumference of same.

The two material strips 18, after being deflected by the deflecting roller 48, are guided over a first spreading member, namely over two spreading rollers 51, 52, which are arranged at a slight distance to one another and mounted on a bearing rod connected to the bearing lever 49.

Subsequently the two material strips 18—still at a slight distance to one another—run over a double roller 53 as a further guide member. The double roller 53, provided with two separate tracks, is arranged above the strip reel 45 and the bearing lever 49 and furthermore above a compensating pendulum arrangement 54 having a plurality of pendulum-type rollers which can be displaced relative to one another. Mounted between the pendulum-type rollers of the compensating pendulum arrangement 54 are stationary guide rollers 55, 56. These have depressions arranged along the circumference for guiding the two material strips 18 with increasing distance from one another. Following in the conveying direction are two guide members with pairs of guide rollers 59, 60. These are rotatably mounted on stationary axes and arranged at an increasing distance from one another in the conveying direction, thus providing for a divergent guidance of the two material strips 18. Here the guide rollers 59 are mounted in a lower region and the guide rollers 60 are mounted in a upper region so that a large angle of wrap is given for each material strip 18. This also applies to the positioning of the deflecting and guide members located upstream.

The two material strips 18 are applied to the outside of the film web 13 in the region of a deflecting roller of the (two) film webs 13, namely in the region of a junction roller 61. For this purpose, a guide member for the two material strips 18 is disposed in the immediate vicinity, namely above the junction roller 61, said guide member having tracks spaced at the precise required distance of the two material strips 18 from one another. These are two guide rollers 62 configured with a guide groove and disposed on a common supporting rod. In addition, the apparatus is configured according to FIG. 8, FIG. 9 within the meaning of the examples described above, in particular corresponding to FIG. 2.

A special feature is shown in FIG. 10. For double-web operation two material strips 18 are here wound on two separate reels, namely single reels 46, 47. The winding structure of the material strips The wound structure of the material strips 18 match each other so that during synchronous-drive operation these two material strips 18 are always guided parallel to each other at the predetermined distance when they are unwound. A special feature according to FIG. 10 consists in the fact that both single reels 46, 47 are wound on a common bearing member, namely on a common, tube-shaped reel core. The two single reels 46, 47 are wound as independent units at a slight distance to one another. In the production of the single reels 46, 47 on a common reel core 63, it is expedient to create a matching winding structure so that both material strips 18 can be drawn off from the two single reels 46, 47 in parallel fashion with a matching relative position of the markings. In the process, the reel core 63 rests with its usual center opening on a bearing journal 65 which is rotary driven.

The guide members for the two material strips 18 are configured analogous to FIG. 9 so that the side view according to FIG. 8 also applies to the exemplary embodiment according to FIG. 10. Only the spreading rollers 51, 52 are disposed on the common bearing rod at a distance from one another corresponding to the positioning of the material strips 18 and can be moved back and forth on same according to the winding structure as the material strips 18 are being unwound. Furthermore the double roller 53 is broken down into two rollers 64 arranged at the corresponding distance. These rollers 64 bring about an alignment of the material strips as they are unwound across the width of the single reels 46, 47 to a specific parallel winding direction. The guide rollers 55 and 56 are provided with guide grooves arranged at a greater distance from one another. Likewise, the guide rollers 59 and 60 are also spaced at the same distance corresponding to the distance of the two material strips 18 from one another. The guide rollers 62 are configured in the same manner and arranged as shown in the exemplary embodiment according to FIG. 9. This also applies to the remaining aspects of the apparatus.

The special embodiment of the reels and their handling according to FIG. 11 and FIG. 12 can also be employed with other (narrow) material webs, in case two or more webs are to be processed simultaneously and synchronously.

The invention claimed is:

1. Process for producing cigarette packs (10) of the hinge-lid type with an outer wrapper made of film and with a tear-open strip (12) applied to the outer wrapper, comprising the steps of:

a) drawing a continuous film web (13) off of a reel (15), the continuous film web (13) having been provided with precisely positioned printed markings (25) thereon during production of the continuous film web (13), the continuous film web (13) also having decorative or informative printing thereon, b) drawing a material strip (18) for producing the tear-open strip (12) off of a separate strip reel (19), the material strip (18) having been provided with precisely positioned printed markings (24) thereon during production of the material strip (18), the material strip (18) also having decorative or informative printing thereon, and producing tear open strip (12) from said drawn material strip (18), c) feeding the tear-open strip (12) to the continuous film web (13) and applying the tear-open strip (12) to the continuous film web (13), d) sensing the printed markings (24) on the tear-open strip (12) by a printed-mark reader (26) after the tear-open strip (12) has been applied to the film web (13), e) sensing the printed markings (25) of the continuous film web (13) by another printed-mark reader (30) after the tear-open strip (12) has been applied to the continuous film web (13), and f) severing blanks (11) for the outer wrapper from the continuous film web (13) to which the tear-open strip (12) has been applied, wherein a severing cut for severing the blanks (11) with the tear-open strips (12) from the continuous film web (13) is controlled in accordance with both the detected printed markings (24) of the tear-open strip (12) and the detected printed markings (25) of the continuous film web (13).

2. Apparatus for producing cigarette packs (10) of the hinge-lid type with an outer wrapper made of film and with a tear-open strip (12) applied to the outer wrapper and likewise consisting of film, comprising:

a) a strip reel (19) containing a material strip (18), a means for producing the tear-open strips (12) from said material strip (18), the material strip (18) having been provided with precisely positioned printing or markings (24) thereon during production of the tear-open strips (12), the material strip (18) also having decorative or informative printing thereon, the material strip (18) being held ready on the strip reel (19) for being drawn off along a path of movement, b) a reel (15) containing the continuous film web (13), the continuous film web (13) having been provided with precisely positioned printing marks (25) thereon during production of the continuous film web (13), the continuous film web (13) also having decorative or informative printing thereon, the continuous film web (13) being held ready on the reel (15) for being drawn off of the reel (15) along the path of movement, c) a means for applying the tear-open strips (12) to the continuous film web (13) along the path of movement after the material strip (18) has been drawn off of the strip reel (19), d) a printed-mark reader (26) located in the region of the path of movement of the tear-open strips (12) applied to the continuous film web (13), wherein the printed-mark reader (26) senses the printed markings (24) of the tear-open strips (12), e) another printed mark reader (30) located in the region of the path of movement of the tear-open strip (12) applied to the continuous film web (13), wherein the another printed mark reader (30) senses the printed markings (25) of the continuous film web (13), f) an evaluation unit, connected to both the printed-mark reader (26) and the another printed mark reader (30), for evaluating the positions of the printed markings (24) on the tear-open strip (12) and the printed markings (25) on the continuous film web (13) sensed by the printed-mark readers, f) a means for severing the continuous film web (13) with the tear-open strips (12) applied thereto to form a blank (11) containing the tear-open strip (12), and g) drive elements for the material strip (18) and the continuous film web (13), whereby the drive elements are controlled by the printed-mark readers (26, 30) via the evaluation unit.

3. A process for producing cigarette packs (10) of the hinge-lid type with an outer wrapper made of film, comprising the steps of:

a) providing a material strip (18) with precisely positioned printed markings (24) and decorative or informative printing thereon;

b) providing a continuous film web (13) with precisely positioned printed markings (25) and decorative or informative printing thereon;

c) feeding the material strips (18) to the continuous film web (13) along a path of movement and attaching the material strips (18) to the continuous film web (13) as tear-open strips (12);

d) sensing the printed markings (24) of the tear-open strips (12) with a printed-mark reader (26);

e) sensing the printed markings (25) of the continuous film web (13) with another printed-mark reader (30);

f) controlling the positioning of a severing cut for severing individual blanks (11) comprising the tear-open strips (12) attached to the continuous film web (13) in accordance with the sensing of the printed markings (24) of the tear-open strips (12) and the printed markings (25) of the continuous film web (13); and then e) severing the individual blanks (11) from the continuous film web (13) having the tear-open strips (12) attached thereto for use as an outer wrapper based on the sensing of the printed markings (24) of the tear-open strips (12) and the printed markings (25) of the continuous film web (13), wherein the blanks (11) comprise a portion of the continuous film web (13) and the tear-open strip (12) and whereby the printed markings (24) of the tear-open strips (12) and the printed markings (25) of the continuous film web (13) are precisely positioned for severing the blank (11) from the continuous film web (13).

4. An apparatus for producing cigarette packs (10) of the hinge-lid type with an outer wrapper made of film, comprising:

a) means for providing a material strip (18) with precisely positioned printed markings (24) and decorative or informative printing thereon and for producing tear-open strips (12);

b) means for attaching the tear-open strips (12) to a continuous film web (13), the continuous film web (13) having precisely positioned printed markings (25) and decorative or informative printing thereon;

c) a printed-mark reader (26), located proximal to a path of movement where the tear-open strips (12) are applied to the continuous film web (13), wherein the printed-mark reader senses the printed markings (24) on the tear-open strips (12);

d) another printed mark reader (30), located proximal to the path of movement where the tear-open strips (12) are applied to the continuous film web (13), wherein the another printed mark reader (30) senses the printed markings (25) of the continuous film web (13), e) an evaluation unit, connected to the printed-mark reader (26) and the another printed mark reader (30), for evaluating the sensed positions of the printed markings (24) on the tear-open strip (12) and the printed markings (25) on the continuous film web (13); and d) drive elements, which are controlled by the printed-mark reader (26) and the another printed mark reader (30) via the evaluation unit, for driving the continuous film web (13) so as to allow the severing of individual blanks (11) for the outer wrapper from the continuous film web (13) at a position based on the sensing of the printed markings (24) on the tear-open strips (12) and the printed markings (25) on the continuous film web (13), whereby the printed markings (24) of the tear-open strips (12) and the printed markings (25) on the continuous film web (13) are positioned in a precise position to the blank (11).

* * * * *